United States Patent [19]

Broderick et al.

[11] 3,995,811

[45] Dec. 7, 1976

[54] NOZZLE FOR DEPOSITING METAL POWDER BY SPRAYING

[75] Inventors: John P. Broderick, New Hyde Park; John E. Lyons, Brooklyn, both of N.Y.

[73] Assignee: Eutectic Corporation, Flushing, N.Y.

[22] Filed: May 22, 1975

[21] Appl. No.: 579,847

[52] U.S. Cl. ..... 239/85; 239/567

[51] Int. Cl.[2] ..... B05B 7/20

[58] Field of Search ..... 239/79–85, 239/559, 567, 424.5

[56] References Cited

UNITED STATES PATENTS

| | | | |
|---|---|---|---|
| 2,933,259 | 4/1960 | Raskin | 239/567 X |
| 3,111,267 | 11/1963 | Shepard et al. | 239/79 X |
| 3,352,492 | 11/1967 | Cape | 239/85 |
| 3,592,575 | 7/1971 | Jaeger et al. | 239/559 |
| 3,620,454 | 11/1971 | Broderick et al. | 239/79 |

FOREIGN PATENTS OR APPLICATIONS

| | | | |
|---|---|---|---|
| 556,029 | 4/1957 | Belgium | 239/559 |

*Primary Examiner*—John J. Love
*Attorney, Agent, or Firm*—Hopgood, Calimafde, Kalil, Blaustein and Lieberman

[57] ABSTRACT

An improved nozzle is provided for a metal spraying torch, said nozzle comprising a hollow cylindrical body having a substantially conically shaped nose terminating into a tip and a plurality of gas-conducting orifices communicating with the hollow of said nozzle and passing substantially axially through the nose of said nozzle, for example, coaxially parallel or conically disposed relative to the axis of the nozzle, and emerging from the conical surface thereof short of the tip. The orifices are radially disposed about the axis of said nozzle with the terminal portions thereof lying in a circle when observed from the tip end. An advantage of the nozzle is that it provides a quieter flame and also avoids flashback when the tip thereof makes contact with a workpiece.

5 Claims, 8 Drawing Figures

NOZZLE FOR DEPOSITING METAL POWDER BY SPRAYING

This invention relates to flame spray torches and, in particular, to an improved nozzle construction for said torches.

STATE OF THE ART

It is known to spray metal powder by means of an oxyacetylene flame wherein the metal powder is deposited in the flame and the powder propelled thereby to a metal substrate, the metal powder melting or fusing in flight such that it bonds to the metal surface to form a metal coating thereon having desired properties, such as resistance to corrosion, resistance to wear and other useful chemical and physical properties.

The powder generally has a particle size range and may involve an alloy powder or a heterogeneous mixture of two or more powdered metals. Thus, where the powder is heterogeneous and/or has a particle size range, the powder spray should be as uniform as possible to minimize segregation in flight since this adversely affects the spray pattern and hence the quality of the deposited metal coating.

The manner in which the powder is dropped into the flame is important and this is brought out in U.S. Pat. No. 3,352,492 in the name of Arthur T. Cape, said patent having issued on Nov. 14, 1967. In this patent, the nature of the oxyacetylene flame is discussed, the flame being described as being constituted of an inner cone of unburned gases and an outer relatively cool zone in which all the carbon is consumed and the color of which is bluish. In feeding the powder into the flame, it is preferably dropped into the bluish cone at a point about one-third of the distance from the end of the nozzle or tip to the end of the bluish cone. This enables the powder to be carried by the flame to a maximum distance to the receiving metal substrate with the desired spray pattern. When the powder is dropped into the flame outside of the aforementioned flame region, the distance of travel of the powder is reduced. The purpose of controlling the position of feed of the powder into the flame is to provide a more uniform or equal distribution of powder with respect to the flame and with respect to the metal substrate receiving the coating.

Over the past several years, the trend has been in the development of various types of powders for specific uses in powder metal spraying. Such powders generally had different flow characteristics which had an effect on spray pattern and density of the powder spray. In order to compensate for the differences in powder characteristics and assure the desired spray pattern, attempts were made to develop torches to enable the use of a wide variety of powders that could be fed in a direct and simple manner by gravity to the proper location in the flame under conditions to inhibit segregation of the powder during transport to the flame.

A torch which was developed having the foregoing characteristic is described in U.S. Pat. No. 3,620,454 (issued Nov. 16, 1971) which is assigned to the same assignee. This torch is capable of handling powders of different characteristics, including powder mixtures which react exothermically and generate heat during metal spraying. Such powders are particularly useful in producing a bond coat which serves as a foundation layer for receiving and anchoring other metal powders used in producing a final coat. It is important that the powder used for the bond coat be applied with the right spray pattern to assure maximum bonding over the area of the metal substrate being coated.

Flame characteristic is another important variable in achieving the desired spray pattern. Thus, there should be a relatively smooth flow of gases with minimum turbulence which will smoothly carry the powder to and firmly apply it to the metal substrate without adversely affecting the spray pattern in flight. A disrupted or turbulent spray pattern may result in less than adequate adhesion to the metal substrate, particularly with regard to the application of a bond coat using powder mixtures which react exothermically in the flame during flight to the metal substrate.

Present day nozzles are designed to provide as smooth a flame as possible. Such nozzles generally have a plurality of gas flow orifices at the tip of the nozzle, the tip terminating into a flat face through which the orifices emerge. While such nozzles have been very successful, they are subject in the field of flashback when the tip, through inadvertence, is caused to touch a workpiece or an element of a workframe or bench such that the orifices are blocked off, whereby flashback may occur which can be dangerous to the operator. The reason flashback can occur is that the fuel gas and oxygen are mixed in the nozzle chamber before the gas mixture is ignited. Thus, when the flame outside the nozzle is blocked off, the flame recedes or backs up into the mixing chamber and becomes hazardous. Thus, an improved torch should include the added feature of being substantially flashback-proof.

While the torch described in U.S. Pat. No. 3,620,454 has been a marked improvement in achieving some of the foregoing objectives, further improvement in flame control, flashback, spray pattern and the like would be desirable, particularly with regard to spray powders which have been developed for use in a variety of applications.

It has now been found that the foregoing can be achieved by means of a new nozzle construction which provides better flame control, which is designed to prevent flashback and which improves spray pattern as evidenced by the quality of bond coat obtained with the new nozzle.

OBJECTS OF THE INVENTION

It is thus the object of the invention to provide an improved nozzle construction characterized by improved flame stability.

Another object of the invention is to provide an improved nozzle for use in spraying metal powder, said nozzle being designed to prevent flashback during use.

A still further object is to provide a metal spraying nozzle characterized by improved powder spray pattern during use and improved laminar flow.

It is also an object of the invention to provide a flame spray torch having an improved nozzle construction.

These and other objects will more clearly appear when taken in conjunction with the following disclosure, the appended claims and the accompanying drawings, wherein:

STATEMENT OF THE INVENTION

In its broad aspects, the invention is directed to an improved nozzle construction for use with a torch for supplying a powdered metal through a flame to a workpiece, the nozzle comprising a hollow cylindrical body having a converging conically shaped nose terminating into a tip, and a plurality of gas-conducting orifices communicating with the hollow chamber of said nozzle and passing substantially axially through the nose of said nozzle and emerging from the conical surface thereof short of the tip, said orifices being disposed substantially radially or circumferentially about the axis of said nozzle, with the emerging ends thereof lying in a circle on the conical surface adjacent the tip when observed from the tip end of said nozzle. The intersection of each of the emerging orifices with said surface may define either a circle or substantially an elliptical opening. For example, the conical nose may have an annular step or shoulder transverse to the axis of said nozzle at which the orifices terminate, each of said orifices defining a circle.

It has been found that by having the gas-conducting orifices pass through the surface of the nose of the nozzle and not the flat face of the tip, a smoother, more stable and quieter flame is obtained.

Figure 1:
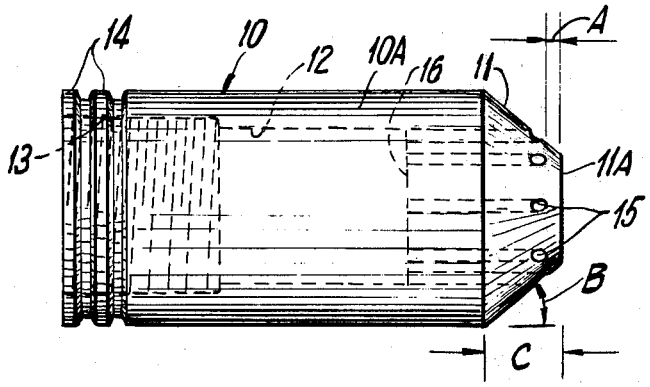
FIGS. 1 to 3 are illustrative of one embodiment of the improved nozzle of the invention.

Referring to FIG. 1, a hollow nozzle 10 is shown having a tapered nose 11 as shown, said nozzle having an inner bore 12 located axially therein which communicates with and defines a gas chamber with an outer bore 13 of slightly larger diameter which is connectable to a stem not shown through which the gas mixture is fed into nozzle 10. The nozzle which is preferably made of tellurium copper has a series of annular grooves or fins 14 at the coupling end thereof to serve as cooling radiators to control the temperature of the nozzle.

The tapered nose 11 terminates into a tip 11A which constitutes a flat circular face as shown. The end wall 16 of the bore including tapered nose 11 is fairly thick relative to the size of the nozzle and it is through this end wall and the tapered nose that gas-conducting orifices 15 are substantially axially formed. The thick end wall also behaves as a heat sink in conducting heat away from the tip of the nozzle. The plurality of gas-conducting orifices is disposed radially or conically about the axis of the nozzle and passes through the conical surface a short distance A short of tip 11A, the orifices forming elliptical openings on the conical surface as shown in FIG. 1. In the end view shown in FIG. 2 looking towards the tip end 11A, it will be noted that the orifices emerging from the conical surface of the nose of the nozzle lie substantially in a circle.

Thus, when an oxyacetylene gas mixture enters the gas chamber defined by bores 12 and 13 and passes through the orifices and is ignited as shown, a plurality of uniform jets 19 is formed, each jet having an inner cone 17 of unburned gas and an outer cone 18 having a bluish color. By having the jets emit from the inclined face of the nose rather than directly from the tip as is the the practice, a more stable flame is provided which is not extinguished when the tip 11A of the nose of the nozzle touches an interfering surface, since the orifices are back of the tip. It is also believed that the conical surface provides a more streamlining effect of the air aspirated along flame edges as compared to eddy currents which are apt to occur using a flat-tipped surface for the orifices as shown in the prior art nozzle depicted at FIG. 4 which shows a similar nozzle 20 having cooling fins 31 and a conically shaped nose 22 which terminates into a flat tip through which a plurality of orifices 24 emerges, unlike the orifices in FIGS. 1 to 3.

Figure 2:
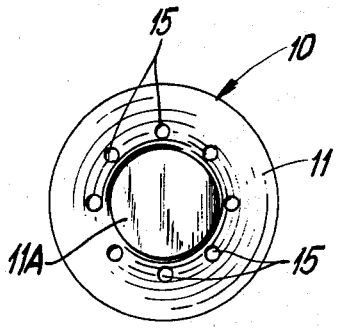
Figure 3:
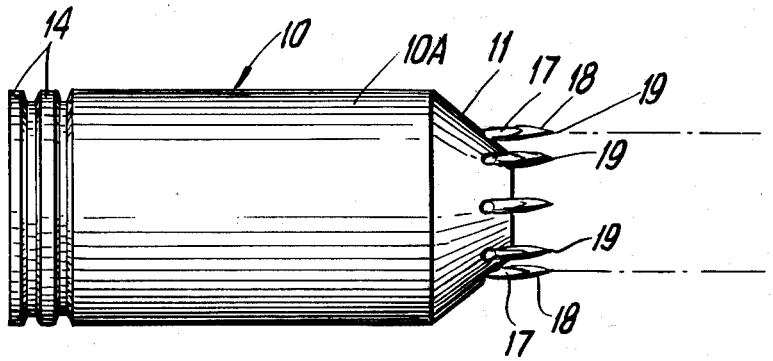

The nozzle 10 of FIGS. 1 to 3 is also fairly thick-walled at 10A to provide a good path together with end wall 16 for the heat generated by the gas jets during spraying so that the temperature of the nozzle does not rise to above critical limits. The orifices 15 which emerge from the conical face of nose 11 are positioned a distance A from the end of tip 11A according to the length C of the conical nose. Thus, the distance A from the tip measured along axial length C of the nose may range from about 8% to the limit imposed by the diameter of the gas chamber, and, more preferably, from about 10% to 25% of the axial length of the nose.

The angle B of the tapered nose with the axis of the nozzle is preferably about 45°. However, the angle may range from about 20° to 60° and, more preferably, from about 30° to 50°. A typical nozzle is one measuring in total length of about 1.642 inches, with the length C of the nose measuring about 0.230 inch, the angle of taper B of the nose being about 45°. The diameter of the nozzle is about 0.750 inch, the inner bore about 0.468 inch in diameter, the large bore about 0.504 inch in diameter, the circular flat tip or face 11A having a diameter of about 0.343 inch. The orifices each have a diameter of about 0.031 inch, eight orifices being drilled axially through the end wall 16 and being circumferentially or conically disposed about the axis of the nozzle at a radial distance of 45° from each other (note FIG. 2).

Figure 6:
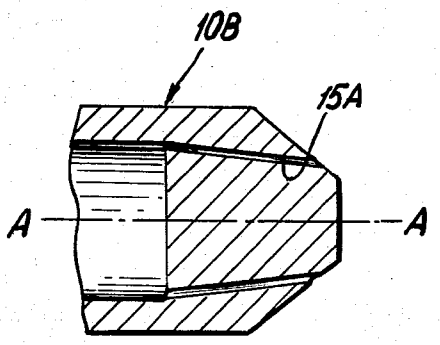
FIG. 6 is a fragment of a nozzle tip or nose showing in cross section the orifices passing substantially axially through the tip but arranged conically about the axis thereof.

Reference is made to FIG. 6 which shows a fragment of a nozzle 10B in cross section showing orifices 15A passing axially through the nozzle but being conically disposed relative to axis A–A thereof as shown.

Figure 7:
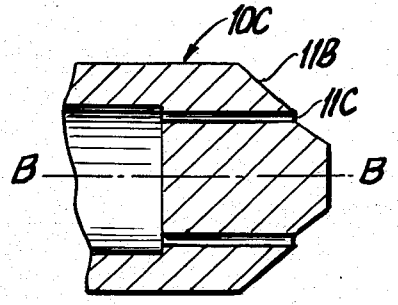
FIG. 7 is a fragment of a nozzle tip showing a conical surface with a step or shoulder therein.

In FIG. 7, a nozzle fragment 10C is shown with the conical nose 11B interrupted by an annular step or shoulder at which the orifices terminate, the step being shown at right angles to the axis B—B of the nozzle.

Figure 8:
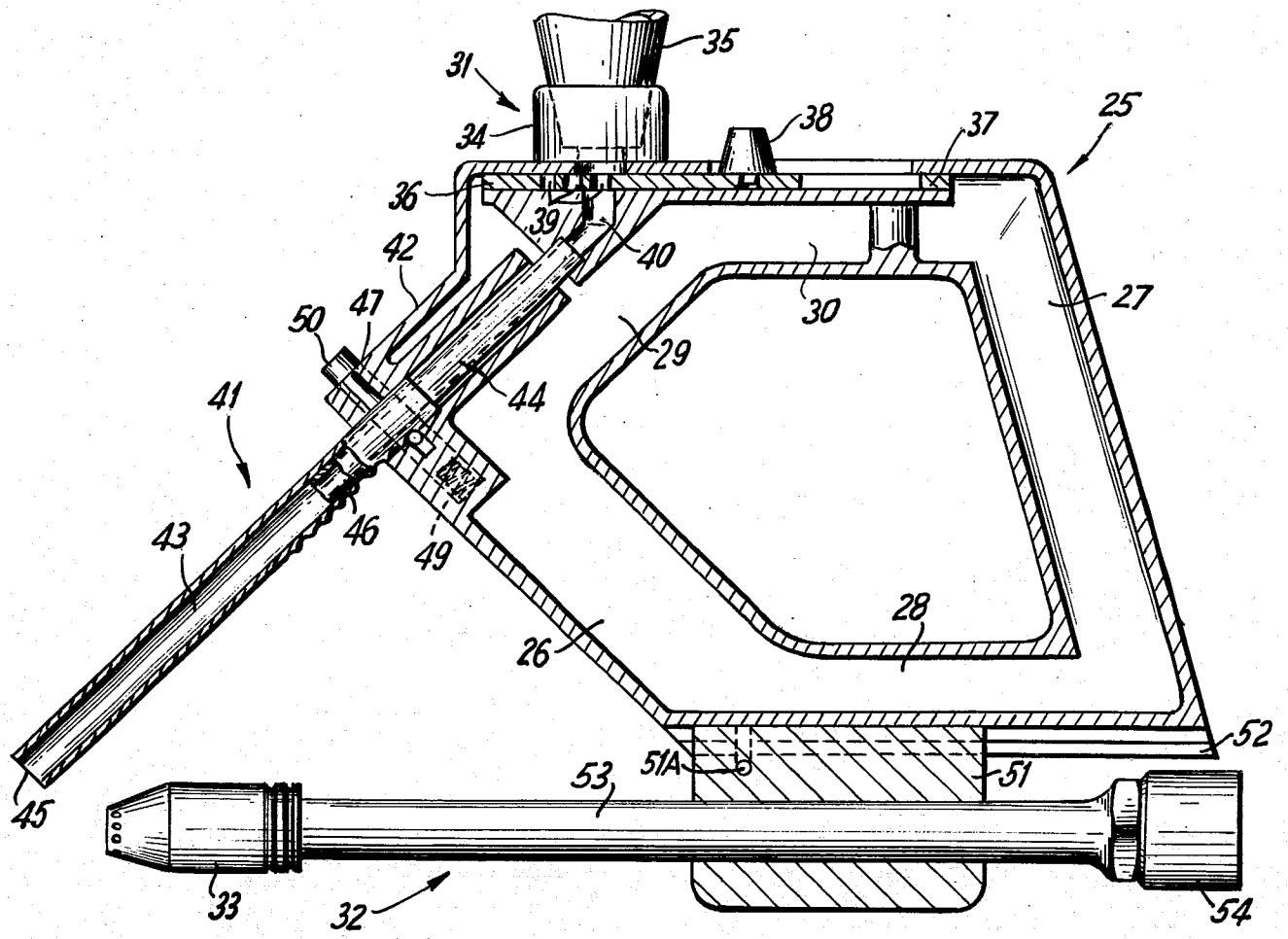
FIG. 8 shows one embodiment of a metal spraying torch utilizing the novel nozzle construction of the invention.

The improved nozzle of the invention is particularly useful with the flame spray torch shown iin FIG. 8. The flame spray torch 25 shown is adapted for gravity feed of metal powder directly to the flame issuing from the nozzle.

The torch has a housing in the shape of a five-sided polygon with one leg of the polygon arranged as a handle portion 27, another leg as a base portion 28, a further leg as a feed portion 29, and another leg of the polygon as the top portion of the torch. The housing 26 has coupled to it a powder feed assembly 31 and a flame assembly 32 to which is coupled the new and improved nozzle 33 of the invention.

The top portion 30 is provided with a fitting 34 adapted to receive a receptacle 35 for holding the alloy powder, a metering device being employed to control powder feed comprising a feed actuator plate 36 slidably mounted in a slot 37 located in the housing top port 30 below fitting 34. Feed plate 36 is provided with a knob 38 which protrudes upwardly above the housing and permits the sliding of feed plate 36 reciprocally toward and away from housing feed portion 29.

It is known that metal powders used in metal spray torches vary in composition and in particle size from approximately 25 mesh to finer sizes and that such powders have different flow rates. Optimum powder spray results for particular applications are obtained within specific powder spray densities which are determined by powder flow rates. Best results are obtained by direct gravity flow which are determined by experimentation for each powder. Thus, it has been found that powder flow and spray rates for powder flowing by gravity unhindered through circular orifices in sizes ranging from 0.075 to 0.120 inch for different alloy powders can be maintained substantially constant over a mesh size range of minus 50 to plus 400 mesh.

In achieving the desired flow rate, feed plate 36 is selectively aligned with powder flow orifice 39 to control variably the flow rate of the powder from receptacle 35 through flow orifice 39 through conduit 40 and through variable spray control assembly 41. Assembly 41 has a housing 42 which holds a powder feed tube 43 and having a central core hollow cylinder 44 slidably and telescopically fitted within feed tube 43 and communcating directly with powder flow conduit 40 to deliver powder directly by gravity to feed tube 43 through discharge end 45. A portion of the outer surface of feed tube 43 is provided with indexiing means or grooves 46 which through latching assembly 47 enables the setting of powder feed tube 43 in order to locate discharge end 45 at the correct distance from the flame end of nozzle 33. The latching assembly comprises a holding pin 48 that is normally urged toward one of the indexing grooves 46 by spring 49, the holding pin 48 being actuated by rod 50 in making the setting. Thus, by depressing rod 50, the pin is moved out of contact with one of the indexing grooves and tube 43 set according to the desired position. This position can be set at the factory and may not require further setting later.

The flame assembly 32 is supported by sliding element 51 which can be lockingly moved along a track 52 located at the bottom leg of housing 26, a locking pin 51A being provided as shown. Gas flow tube 53 is fixedly held by sliding element 51 and may be factory set, one end of the tube having a connector 54 for attaching to a source of oxygen and acetylene.

By employing the new and improved nozzle 33 of the invention with a gravity feed torch of the foregoing type as one example of use, it being understood that the nozzle may be used with other torches as well, unexpected results are achieved which add to the inherent advantages of this type of torch. This will be apparent from the following test conducted with the nozzle of the invention using the torch arrangement shown in FIG. 8.

Figure 4:
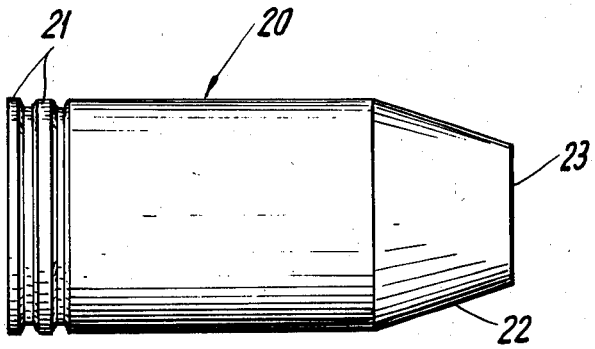
(PRIOR ART) FIG. 4
FIGS. 4 and 5 depict a prior art nozzle which tends to cause flashback during use when the tip thereof inadvertently contacts a workpiece or an element of a workframe or bench.
Figure 5:
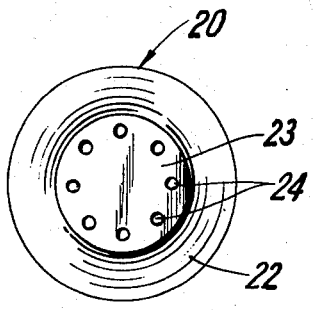
(PRIOR ART) FIG. 5

Several tests were conducted, (1) with a prior nozzle shown in FIGS. 4 and 5 hereinafter referred to as the standard nozzle, and (2) with the nozzle of the invention illustrated in FIGS. 1 to 3.

In a first test, a standard oxyacetylene flame was produced as would normally be used for flame spraying, except that powder was not fed through the flame for use in the flashback test. In the case of the standard nozzle (FIG. 4), the tip thereof was touched against the surface of the workpiece which resulted in an immediate flashback when the orifices were blocked off. In the case of the novel nozzle of the invention, the same test showed no flashback whatever and, moreover, the flame did not extinguish but stayed lit at the end of the tip where it should be.

The so-called standard nozzle (FIG. 4) had the same number and size of orifices discussed hereinabove with regard to the nozzle of the invention, that is, eight orifices having a diameter of about 0.031 inch. In comparing the flames of each nozzle before metal spraying, the flame issuing out of the nozzle of the invention and under the same gas-flow conditions was quieter. The noise level of the standard tip or nozzle was measured at about 93 decibels while that of the new nozzle was 85 decibels. This is a large improvement (approximately 10% less noise) when it is considered that the spray pattern of the powder is very sensitive to flame conditions.

Although the flame envelope of the new nozzle is the same length, it is narrower, more symmetrical and tends to be less divergent, that is, does not tend to spread out as much. The flame appears more stable and tends to flutter less, particularly with respect to the tips of the inner zone. The new nozzle does not show the pulsating action of the standard nozzle.

Moreover, the inner cores are more pointed and decidedly less bulbous, which characteristic is an indication of stability and balance.

The temperature of the nozzle in service is essentially similar to the aforementioned standard nozzle. After 1 minute of use, the nozzle temperature is about 180° F; after 3 minutes, about 240° F; and after 8 minutes, it attains a maximum steady state temperature of 280° F, which temperature did not exceed 280° F after 15 minutes.

Another test conducted was the spray test. In this test, a rate and deposition efficiency was determined using a gas regulator setting of 4 psi $C_2H_2$ and 8 psi $O_2$, the gases being fed to the nozzles at a flow rate of 23 C.F.H. (cubic feet per hour) of $O_2$ and 36 C.F.H. of $C_2H_2$.

A bond coat powder was sprayed comprising a mixture of nickel powder and an exothermic reacting metal powder onto a roughened mild steel plate using the standard nozzle in one test and the novel nozzle of the invention in another test. Because of the nature of the powder, a reaction occurs in the flame which results in an increase in spray temperature of the nickel particles which deposit on and bond to the steel surface. After the bond coat is applied, an aluminum bronze powder is then sprayed over the bond coat.

The final coating produced with the nozzle of the invention exhibited a better quality than the coating with the standard nozzle. The nozzle of the invention also provided improved bonding of the bond coat of over about 5% which adds further to the final quality of the coating. The rate and deposition efficiency was 90% at a spray rate of 5.81 lbs/hour.

It is to be understood that the term "conically shaped nose" is meant to include a smooth conical surface as well as a conical surface with an annular step or shoulder therein.

Although the present invention has been described in conjunction with preferred embodiments, it is to be understood that modifications and variations may be restored to without departing from the spirit and scope of the invention as those skilled in the art will readily understand. Such modifications and variations are considered to be within the purview and scope of the invention and the appended claims.

What is claimed is:

1. A powder flame spray torch and nozzle assembly comprising a housing means for externally feeding powder by gravity through a conduit extending to a flame issuing from a nozzle coupled to means on said housing through which a combustible gas is fed to and through said nozzle, said nozzle comprising, a hollow cylindrical body defining a gas chamber and having a converging conically shaped nose terminating into a closed tip, and a plurality of gas-conducting orifices communicating with the gas chamber of said nozzle and passing through the nose of said nozzle substantially coaxial with the axis of said nozzle and emerging from the conical surface thereof short of the tip, said orifices being disposed radially about the axis of said nozzle and lying in a circle on said conical surface adjacent the tip when observed from the tip end of said nozzle.

2. The nozzle of claim 1, wherein said conically shaped nose has a taper in cross section which makes an angle with the axis of said nozzle ranging from about 20° to 60°.

3. The nozzle of claim 2, wherein the angle of taper ranges from about 30° to 50°.

4. The nozzle of claim 1, wherein the orifices passing through the nose of the nozzle emerge from the conical surface thereof at a distance in from the tip ranging from about 8% of the axial length of the nose to the limit imposed by the diameter of the gas chamber.

5. The nozzle of claim 4, wherein the orifices passing through the nose of said nozzle emerge from the conical surface thereof at a distance in from the tip rangiing from about 10% to 25% of the length of the nose.

* * * * *

UNITED STATES PATENT OFFICE

CERTIFICATE OF CORRECTION

Patent No. 3,995,811 Dated December 7, 1976

Inventor(s) John P. Broderick et al.

It is certified that error appears in the above-identified patent and that said Letters Patent are hereby corrected as shown below:

Claim 1, col. 7, line 2, after "housing" insert --having--.

col. 7, line 5, after "which" delete "a".

Claim 5, col. 8, line 16, "rangiing" should be --ranging--.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*